US008029115B2

(12) United States Patent
Usui

(10) Patent No.: US 8,029,115 B2
(45) Date of Patent: Oct. 4, 2011

(54) LIQUID EJECTION DEVICE

(75) Inventor: Takamasa Usui, Ogaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 555 days.

(21) Appl. No.: 12/039,283

(22) Filed: Feb. 28, 2008

(65) Prior Publication Data

US 2008/0204488 A1 Aug. 28, 2008

(30) Foreign Application Priority Data

Feb. 28, 2007 (JP) ..... 2007-050072

(51) Int. Cl.
*B41J 2/175* (2006.01)
*B41J 29/393* (2006.01)

(52) U.S. Cl. ..... 347/86; 347/19

(58) Field of Classification Search ..... 347/7, 84–87, 347/19

See application file for complete search history.

(56) References Cited

U.S. PATENT DOCUMENTS

| | | | | |
|---|---|---|---|---|
| 6,796,627 | B2 * | 9/2004 | Kimura et al. | 347/7 |
| 7,008,034 | B2 | 3/2006 | Tsukada et al. | |
| 7,185,974 | B2 | 3/2007 | Katayama | |
| 7,278,722 | B2 | 10/2007 | Sasaki et al. | |
| 7,306,308 | B2 | 12/2007 | Tsukada et al. | |
| 7,325,913 | B2 | 2/2008 | Sasaki et al. | |
| 7,334,888 | B2 | 2/2008 | Sasaki et al. | |
| 7,334,889 | B2 | 2/2008 | Sasaki et al. | |
| 7,350,909 | B2 | 4/2008 | Takagi et al. | |
| 7,384,136 | B2 | 6/2008 | Takagi et al. | |
| 2005/0134663 | A1 | 6/2005 | Sasaki et al. | |
| 2005/0146577 | A1 | 7/2005 | Sasaki et al. | |
| 2005/0146578 | A1 | 7/2005 | Takagi et al. | |
| 2005/0151812 | A1 | 7/2005 | Sasaki et al. | |
| 2005/0195225 | A1 | 9/2005 | Takagi et al. | |
| 2006/0001717 | A1 | 1/2006 | Sasaki et al. | |
| 2007/0273736 | A1 | 11/2007 | Sasaki et al. | |

FOREIGN PATENT DOCUMENTS

| | | | |
|---|---|---|---|
| JP | 2005-066906 | A | 3/2005 |
| JP | 2005-161637 | A | 6/2005 |
| JP | 2005-161640 | A | 6/2005 |
| JP | 2005-246781 | A | 9/2005 |
| JP | 2006-218876 | A | 8/2006 |

OTHER PUBLICATIONS

Japan Patent Office, Office Action in Japanese Patent Application No. 2007-050072 (counterpart to the above-captioned U.S. Patent Application) mailed Jan. 27, 2009. (partial translation).

* cited by examiner

*Primary Examiner* — An Do
(74) *Attorney, Agent, or Firm* — Baker Botts L.L.P.

(57) ABSTRACT

A liquid ejection device of a first aspect of the invention includes a sub tank capable of fluid communicating with the main tank removably mountable to the liquid ejection device. The sub tank is configured to satisfy the formula: $S_H - S_L \leqq M_H - M_N$ where $S_H$ is a liquid amount in the sub tank in a balanced state at which the liquid has flowed into the sub tank by a hydraulic head pressure on mounting the main tank with the liquid fully filled; $S_L$ is a liquid amount in the sub tank in a state where the liquid level is positioned at the outlet of the sub tank; $M_H$ is a liquid amount in the main tank when the liquid is fully filled in the main tank; and $M_N$ is a liquid amount in the main tank in a state where the liquid level is positioned at a threshold level.

9 Claims, 8 Drawing Sheets

LIQUID EJECTION DEVICE

CROSS-REFERENCE TO RELATED APPLICATIONS

This application is based upon and claims the benefit of priority from Japanese Patent Application No. 2007-050072, filed on Feb. 28, 2007, the entire contents of which are incorporated herein by reference.

TECHNICAL FIELD

The present invention relates to a liquid ejection device, such as an inkjet printer.

BACKGROUND

As an inkjet printer to which a cartridge type main tank storing ink is removably mounted, there is an inkjet printer including a sensor configured to detect a remaining amount of ink in the main tank. As an example of the detection of the remaining ink amount, the remaining ink amount sensor optically detects a position of a float provided in the main tank which descends with the lowering of the ink level. Accordingly, the remaining ink amount can be detected with high accuracy. However, the float reaches the bottom of the main tank even in a state where the ink remains in the main tank. Therefore, a state where the remaining ink amount becomes zero cannot be detected, and the ink cannot be used up.

Meanwhile, as another method for detecting the remaining ink amount in the main tank, there is a method of cumulatively calculating an ink amount ejected from an inkjet head with software. This method enables the state of zero remaining ink amount to be detected. However, since minute errors may be contained in the ejected liquid amount used in the calculation for each ejection, such errors accumulate by the time the ink in the main tank is used up. Therefore, the remaining ink amount cannot be detected with high accuracy.

In JP-A-2005-246781, the former method for optically detecting the remaining ink amount using the float and the latter method for detecting the remaining ink amount with software are combined to enable the ink to be fully used up and detect the remaining ink amount precisely. Specifically, a seesaw-like float blocks light to a light receiving unit of an optical sensor when ink is filled, and with the lowering of the liquid level according to ink consumption, the float swings and allows the light to enter the light receiving unit of the optical sensor. Accordingly, it is firstly detected that the ink has decreased up to a threshold level (remaining amount detection). Then, the number of ink droplets ejected from the inkjet head is cumulatively calculated with software, which starts at the time of the remaining amount detection. Accordingly, it is secondarily calculated and detected that the remaining ink amount becomes zero (remaining amount calculation). That is, since the calculation of the remaining ink amount with software starts after the amount of ink in the main tank becomes low, error does not accumulate so much and the remaining ink amount can be detected accurately.

In a case where the ink in the main tank is used up and then the main tank is exchanged with a new one, air may enter an ink supplying path leading up to the inkjet head. In a tube supplying type inkjet printer disclosed in JP-A-2005-66906, a sub tank open to an atmosphere is disposed between the main tank and an ink supplying tube to prevent the entry of air into the ink supplying path even if the ink in the cartridge type main tank is used up. Accordingly, even if the ink in the main tank is used up, air does not enter the ink supplying tube since the ink remains in the sub tank. Moreover, even if air enters a connection portion between the main tank and the sub tank during exchange of the main tank, the air is separated by buoyancy from the ink in the sub tank and is thereby prevented from entering the ink supplying tube.

SUMMARY

However, in a case where the remaining ink amount detection method of JP-A-2005-246781 is assumed to be applied to the arrangement disclosed in JP-A-2005-66906, when the main tank is exchanged with a new tank in a state where there is small remaining ink amount in the sub tank, ink flows into the sub tank all at once due to the hydraulic head pressure, thereby causing the ink level in the main tank to drop significantly immediately after exchange. That is, simply exchanging the main tank results in that the ink level may fall below the threshold level at which the remaining amount detection by the optical sensor is performed. Incidentally, the remaining amount calculation by software is started immediately from that point, and an initial level of the remaining amount calculation is programmed to be the threshold level. Therefore, when the actual ink level is lower than the threshold level from the beginning, the remaining ink amount is calculated to be greater than the actual amount.

An object of an aspect of the present invention is to perform precise detection of a remaining liquid amount in the main tank while enabling the liquid in the main tank to be used up as much as possible, in a liquid ejection device with a sub tank into which a liquid flows from a main tank due to a hydraulic head pressure.

According to an aspect of the invention, there is provided a liquid ejection device comprising: a main tank mounting unit to which a main tank capable of storing liquid is removably mountable; a sub tank comprising: an inlet configured to be brought into fluid communication with the main tank in a state where the main tank is mounted to the main tank mounting unit; and an outlet; an ejection head having a nozzle configured to eject the liquid supplied from the sub tank via the outlet; a remaining amount detecting unit configured to detect whether an amount of the liquid in the main tank is equal to or smaller than a predetermined liquid amount, where a liquid level of the liquid in the main tank at the predetermined liquid amount is positioned at a threshold level; and a remaining amount calculating unit configured to determine a liquid amount ejected from the ejection head during a term starting from a detection of the threshold level by the remaining amount detecting unit, thereby calculating a remaining liquid amount in the main tank; wherein the sub tank is configured to satisfy the following formula: $S_H - S_L \leqq M_H - M_N$, where, $S_H$ is a liquid amount in the sub tank in a balanced state at which the liquid has flowed into the sub tank by a hydraulic head pressure on mounting the main tank with the liquid fully filled; $S_L$ is a liquid amount in the sub tank in a state where the liquid level is positioned at the outlet of the sub tank; $M_H$ is a liquid amount in the main tank when the liquid is fully filled in the main tank; and $M_N$ is a liquid amount in the main tank in a state where the liquid level is positioned at the threshold level.

DESCRIPTION

An embodiment according to the present invention shall now be described with reference to the drawings.

Figure 1:
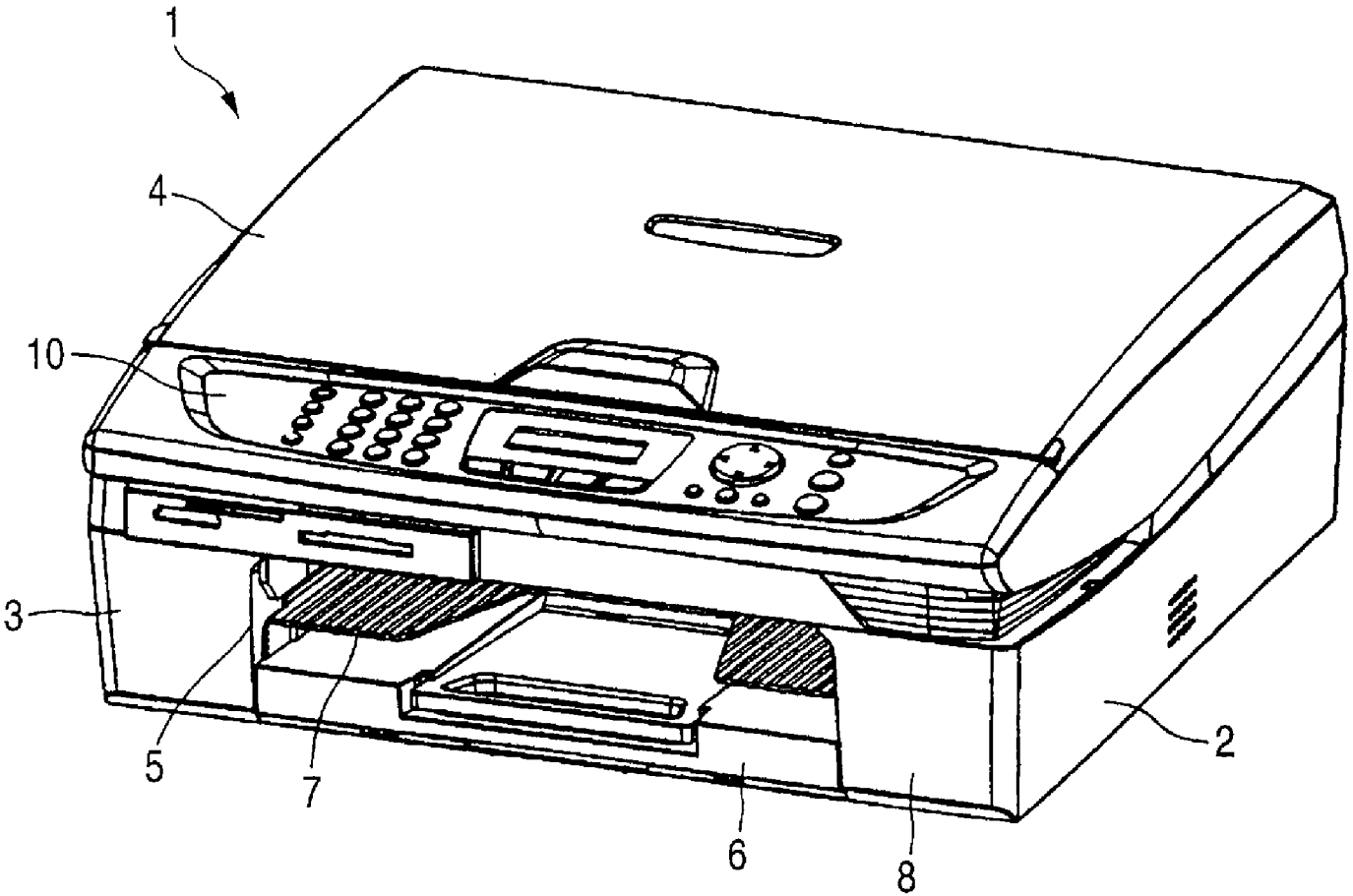
FIG. 1 is a perspective view of a multi function device having an inkjet printer (liquid ejection device) according to an embodiment of the present invention.

FIG. 1 is a perspective view of a multi function device 1 having an inkjet printer 3 (liquid ejection device) according to an embodiment of the present invention. As shown in FIG. 1, the multi function device 1 has a printer function, a scanner function, a copying function, and a facsimile function, and includes the inkjet printer 3 disposed at a lower portion of a housing 2 thereof and a scanner 4 disposed at an upper portion of the housing 2. An opening 5 is formed on a front surface of the housing 2, a sheet feeding tray 6 of the inkjet printer 3 is disposed at a lower stage of the opening 5, and a sheet discharging tray 7 of the inkjet printer 3 is disposed at an upper stage. An opening/closing cover 8 is disposed at a lower right portion of a front side of the inkjet printer 3, and a main tank mounting unit 28 (see FIG. 2) is disposed at an inner side of the opening/closing cover 8. An operation panel 10 for operation of the inkjet printer 3, the scanner 4, etc is disposed on an upper front side of the multi function device 1. The multi function device 1 is connectable to an external personal computer 11 (see FIG. 2), and is operable according to instructions transmitted from the personal computer 11 via a driver.

Figure 2:
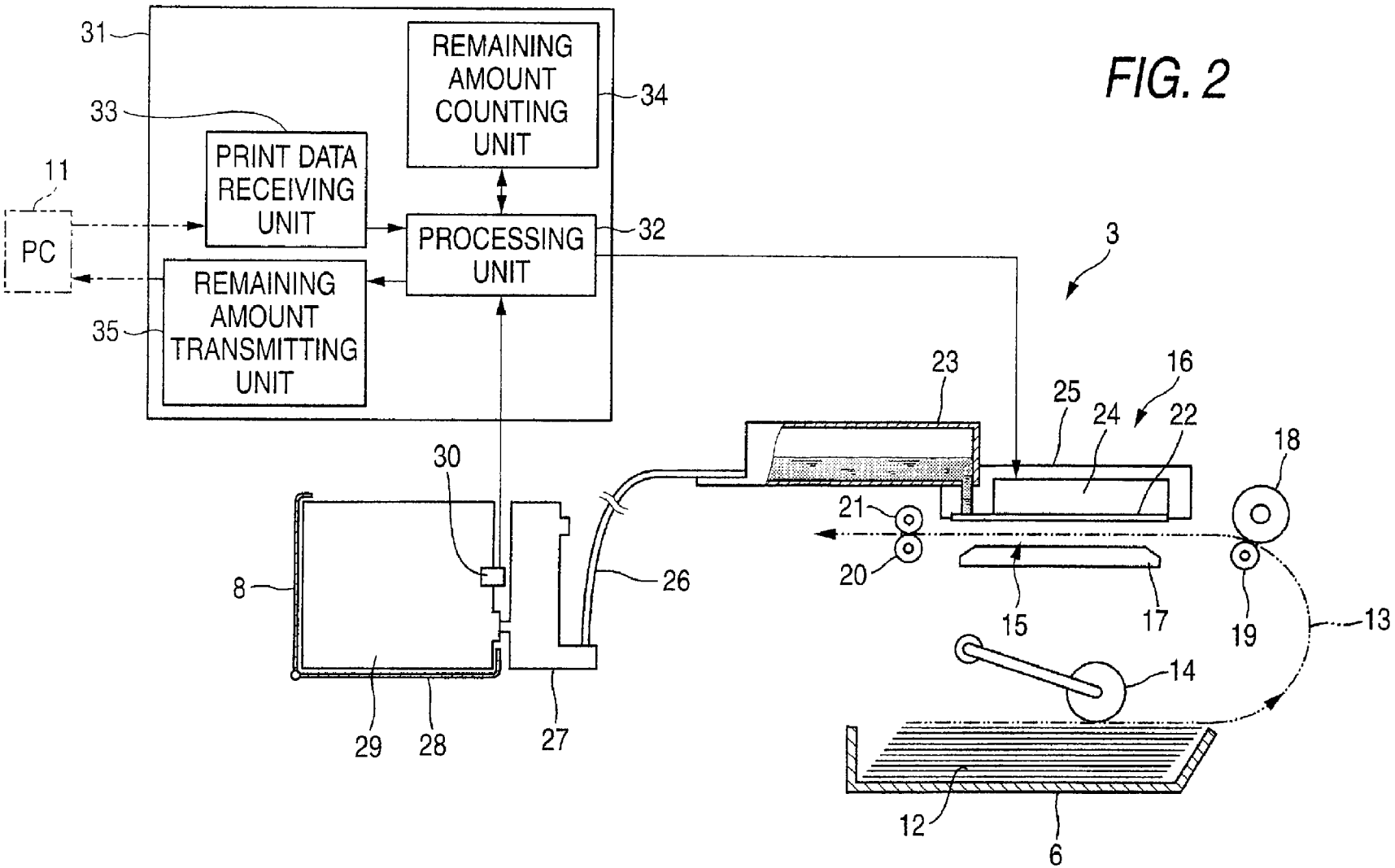
FIG. 2 is a schematic partial sectional view showing the inkjet printer of the multi function device shown in FIG. 1.

FIG. 2 is a schematic partial sectional view showing the inkjet printer 3 of the multi function device 1 shown in FIG. 1. As shown in FIG. 2, the sheet feeding tray 6 is disposed at a bottom side of the multi function device 1. A sheet feeding drive roller 14 is disposed at an upper side of the sheet feeding tray 6 and configured to feed a sheet at a topmost layer of recording sheets 12 placed on the sheet feeding tray 6 to a conveying path 13. The conveying path 13 rises upward from a back side of the sheet feeding tray 6, then turns back toward a front side, passes a printing region 15, and leads to the sheet discharging tray 7 (see FIG. 1).

An image recording unit 16 is disposed at the printing region 15. A platen 17 having larger size than a sheet is disposed below the image recording unit 16. A conveying roller 18 and a pinch roller 19 are disposed at an upstream side of the image recording unit 16 with respect to the conveying path 13 and configured to nip a recording sheet 12 fed from the sheet feeding tray 6 and convey the sheet onto the platen 17. A sheet discharging roller 20 and a pinch roller 21 are disposed at a downstream side of the image recording unit 16 and configured to nip the recording sheet 12 on which printing has been performed and convey the sheet to the sheet discharging tray 7 (see FIG. 1).

The image recording unit 16 includes: an inkjet head 22 (ejection head) of piezoelectric driven type which ejects ink (liquid) toward the platen 17 from a plurality of nozzles; a buffer tank 23 capable of storing the ink to be supplied to the inkjet head 22; a head control board 24 configured to perform drive control of the inkjet head 22; and a carriage 25 on which these elements are mounted. The buffer tank 23 is connected to a sub tank 27, as described later, via an ink supplying tube 26. The main tank mounting unit 28, to which a main tank 29 is removably mountable, is disposed at a position adjacent to the sub tank 27. The opening/closing cover 8 is attached to the main tank mounting unit 28. The main tank mounting unit 28 is provided with a remaining amount detecting sensor 30 (remaining amount detecting unit) that optically detects a remaining ink amount in the main tank 29 in a state where the main tank 29 is mounted.

The remaining amount detecting sensor 30 is connected to a controller 31 (remaining amount calculating unit). The controller 31 is configured to perform the task of detecting the remaining ink amount in the main tank 29, and in addition, the controller 31 is configured to execute operation control of ink ejection from the inkjet head 22, feeding and discharging the recording sheet 12, and various other tasks of the inkjet printer 3. The controller 31 includes a CPU (central processing unit), a ROM configured to store program executed by the CPU and data used in the program, a RAM configured to temporarily store data during execution of a program, a rewritable EEPROM or other memory, an input/output interface, etc. In regard to the remaining ink amount detection function, the controller 31 includes: a processing unit 32 configured to perform process and control; a print data receiving unit 33 configured to receive print data from the personal computer 11; a remaining amount counting unit 34 configured to perform cumulative calculation (remaining amount calculation) of the remaining ink amount in the main tank 29 based on the ink ejection amount at the inkjet head 22; and a remaining amount transmitting unit 35 configured to transmit the remaining ink amount in the main tank 29 to the personal computer 11.

Figure 3:
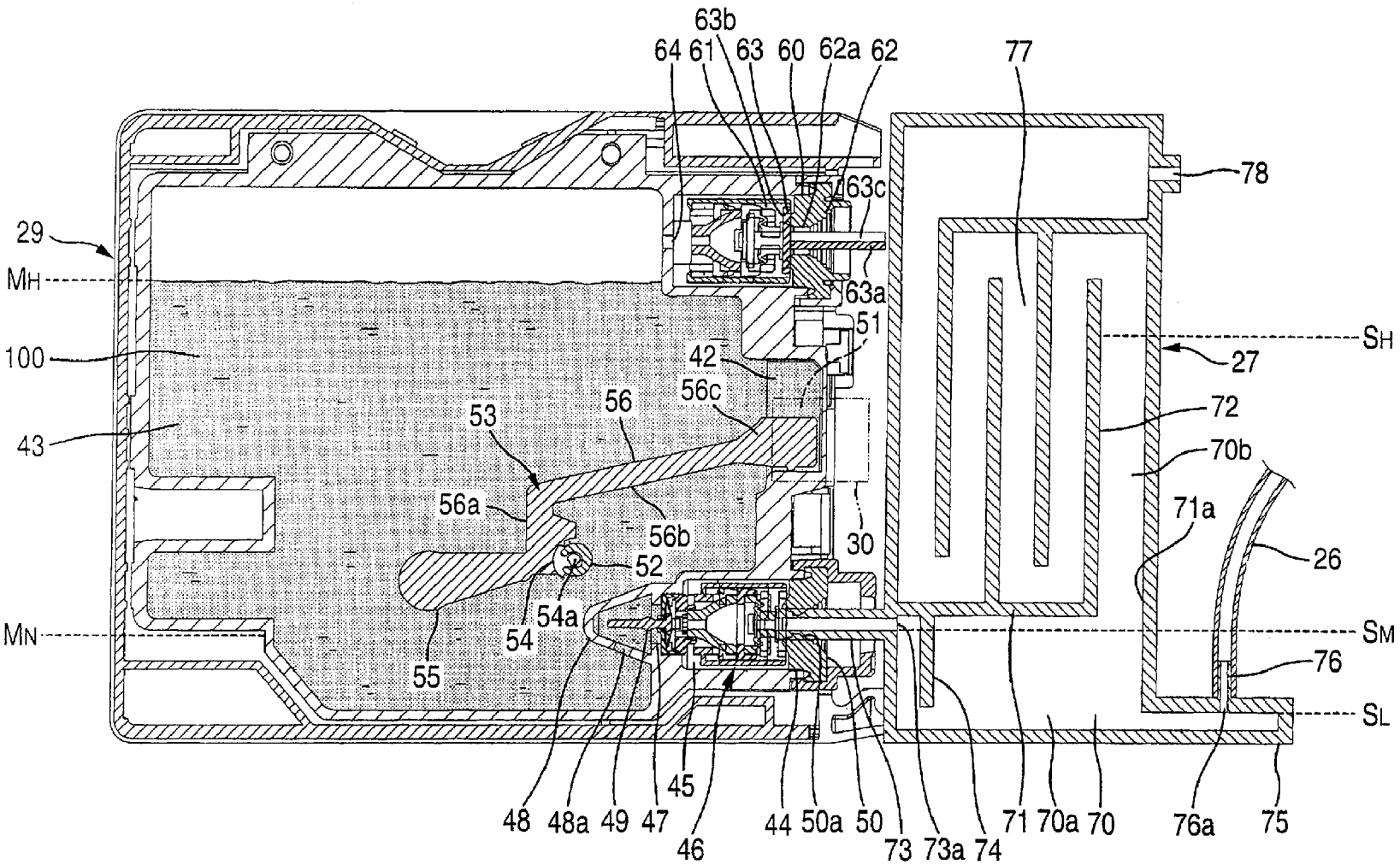
FIG. 3 is a vertical sectional view of a main tank and a sub tank of the inkjet printer shown in FIG. 2.

FIG. 3 is a vertical sectional view of the main tank 29 and the sub tank 27 of the inkjet printer 3 shown in FIG. 2. As shown in FIG. 3, the main tank 29 has an ink storage chamber 43 capable of storing ink 100. As shown in FIG. 3, an opening 44 and a tubular valve housing chamber 45 continuous with the opening 44 are provided at a lower portion of a surface (at the right side in FIG. 3) of the main tank 29 opposing the sub tank 27. The valve housing chamber 45 extends from the opening 44 toward inside the main tank 29, and an ink supplying valve 46 is housed in the valve housing chamber 45. A valve port 47 is formed on an inner surface of the valve housing chamber 45, and a hollow, conical cover portion 48 is protruded from a circumference of the valve port 47 toward the inside the main tank 29.

An inflow port 48*a* is formed at a lower portion of the cover portion 48, and the valve housing chamber 45 is brought into fluid communication with the ink storage chamber 43 via the valve port 47 and the inflow port 48*a*. The valve port 47 is provided with a check valve 49, and the check valve 49 opens the valve port 47 when the ink storage chamber 43 becomes positive in pressure with respect to the valve housing chamber 45 and closes the valve port 47 when the ink storage chamber 43 becomes negative in pressure with respect to the valve housing chamber 45. An annular sealing member 50 is disposed at the opening 44, and an ink outflow port 50*a* is formed at a center portion of the sealing member 50. The diameter of the ink outflow port 50*a* is reduced by elastic force in a non-loaded state.

An opening 60 and a tubular valve chamber 61 continuous with the opening 60 are disposed at an upper portion of the surface (at the right side in FIG. 3) of the main tank 29 opposing the sub tank 27. An annular sealing member 62 is disposed at the opening 60, and an atmosphere opening port 62*a* is formed at a center of the sealing member 62. The valve housing chamber 61 extends from the opening 60 toward inside the main tank 29, and an atmosphere opening valve 63 is housed in the valve housing chamber 61. The atmosphere opening valve 63 includes: a rod portion 63*a* that penetrates through the atmosphere port 62*a* and protrudes toward the sub tank 27 side; and a flange portion 63*b* that projects in outward radial directions from an inner end portion of the rod portion 63*a*. The atmosphere opening valve 63 is urged so that the flange portion 63*b* contacts the sealing member 62 and thereby seals the atmosphere opening port 62*a*. A groove portion 63*c* is disposed along a direction of extension of the rod portion 63*a*, and in a state where the flange portion 63*b* is separated from the sealing member 62, the valve housing chamber 61 is open to an atmosphere via the groove portion 63*c*. A communication port 64 is formed at an inner surface of the valve housing chamber 61, and the valve housing chamber 61 is brought into fluid communication via the communication port 64 with an air layer formed at an upper portion of the ink storage chamber 43.

A recess 42 continuous with the ink storage chamber 43 is formed at a portion of the main tank 29 on the side the sub tank 27. Each of the both side walls of the recess 42 has a light transmitting portion 51 formed of a transmissive material for detecting the remaining amount of the ink stored in the ink storage chamber 43. The main tank 29 includes a supporting portion 52 configured to swingably support a sensor arm 53. The sensor arm 53 includes: a connecting portion 54 having a connecting shaft 54*a* axially supported by the supporting portion 52; a float portion 55 extending to one side (the left side in FIG. 3) from the connecting portion 54; and an arm portion 56 extending to another side (the right side in FIG. 3) from the connecting portion 54.

The float portion 55 is formed to be hollow so that an average specific gravity thereof is less than a specific gravity of the ink. The arm portion 56 includes a first arm 56*a*, a second arm 56*b*, and a blocking portion 56*c*. The first arm 56*a* extends upward substantially perpendicularly with respect to the float portion 55. The second arm portion 56*b* extends from a front end of the first arm 56*a* in a direction away from the float portion 55. The blocking portion 56*c* positioned in the recess 42 is formed at a front end of the second arm portion 56*b*.

The arm portion 56 is less in weight than the float portion 55. Therefore, in a state where there is no ink in the ink storage chamber 43, the sensor arm 53 rotates about the connecting shaft 54*a* in a direction in which the float portion 55 descends. In this process, the blocking portion 56*c* of the sensor arm 53 moves so as to retreat diagonally upward from the recess 42. On the other hand, when the ink storage chamber 43 is adequately filled with ink, the float portion 55 is immersed in the ink, the weight balance of the float portion 55 and the arm portion 56 is reversed due to buoyancy, and the sensor arm 53 rotates about the connecting shaft 54*a* in a direction in which the float portion 55 rises. In this process, the blocking portion 56*c* of the sensor arm 53 moves diagonally downward so as to enter the recess 42.

Figure 4:
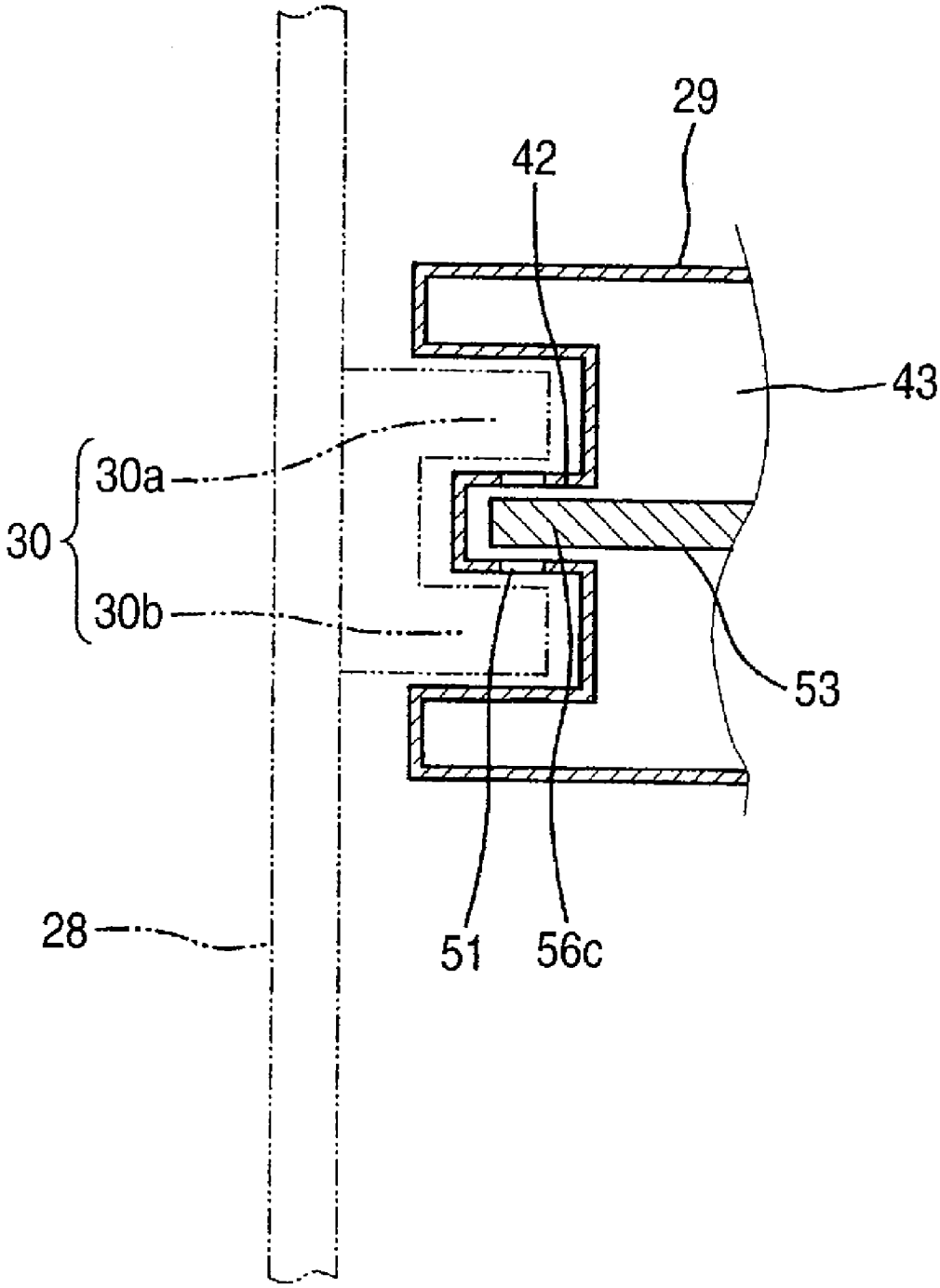
FIG. 4 is a horizontal sectional view of principal portions of the main tank and a remaining amount detecting sensor shown in FIG. 3.

FIG. 4 is a horizontal sectional view of principal portions of the main tank 29 and the remaining amount detecting sensor 30 shown in FIG. 3. As shown in FIG. 4, the main tank mounting unit 28 (see FIG. 2) is provided with the remaining amount detecting sensor 30. The remaining amount detecting sensor 30 has a light emitting portion 30*a* and a light receiving portion 30*b* and outputs a predetermined electrical signal based on a luminance of light emitted from the light emitting portion 30*a* to the light receiving portion 30*b*. Specifically, a transmitting type photo interrupter is used as the detector. The remaining amount detecting sensor 30 is disposed so that the light transmitting portion 51 of the wall surfaces of the recessed portion 42 of the main tank 29 are positioned in a detection region between the light emitting portion 30*a* and the light receiving portion 30*b*.

That is, in a state where the blocking portion 56*c* of the sensor arm 53 enters the recess 42 and is sandwiched by the light transmitting portions 51 at both side walls, the light emitted from the light emitting portion 30*a* is blocked by the blocking portion 56*c* and is not detected by the light receiving portion 30*b*. In this state, the controller 31 (see FIG. 2) determines that: "the ink level is positioned above a threshold level." On the other hand, in the state where the blocking portion 56*c* retreats from the recess 42 and is not sandwiched by the light transmitting portions 51 at both side walls, the light emitted from the light emitting portion 30*a* is detected by the light receiving portion 30*b* via the light transmitting portions 51 without being blocked by the blocking portion 56*c*. In this state, the controller 31 (see FIG. 2) determines that: "the ink level is positioned equal to or below the threshold level."

As shown in FIG. 3, the sub tank 27 has as an ink storage space 70 (liquid storage space) defined therein, and the ink storage space 70 has a lower region 70*a* and an upper region 70*b*. An upper portion of the lower region 70*a* terminates at an upper wall portion 71, and a communicating port 71*a* is formed in a portion of the upper wall portion 71. A tubular portion 72, forming the upper region 70*b*, protrudes upward from a circumference of the communicating hole 71. It is preferable that the upper region 70*b* extends to substantially equal to or above a fully-filled liquid level in the main tank 29 in a state where the main tank 29 is mounted to the main tank mounting unit 28. A horizontal cross-sectional area of the upper region 70*b* is thus made significantly smaller than a horizontal cross-sectional area of the lower region 70*a*. According to this configuration, the horizontal cross-sectional area of the upper region can be made smaller than the horizontal cross-sectional area of the lower region by a simple configuration.

A tubular needle portion 73 protrudes toward the main tank 29 side from an outer wall of the sub tank 27, and the needle portion 73 has an inlet 73*a* that opens toward the lower region 70*a*. In a state where the needle portion 73 is inserted in the ink outflow port 50*a* of the sealing member 50 of the main tank 29, the lower region 70*a* of the ink storage space 70 of the sub tank 27 is brought into fluid communication with the ink storage chamber 43 of the main tank 29. At a position opposite the inlet 73*a*, a flow path wall 74 extends downward from the upper wall portion 71. Furthermore, on an outer wall of the sub tank 27, a protrusion 75 is protruded in a direction away from the inside of the main tank 29. The protrusion 75 has a space defined therein which forms a portion of the lower region 70*a* and a tubular tube attachment portion 76 that protrudes from an upper wall of the protrusion 75 and allows fluid communication with this space.

The tube attachment portion 76 has an outlet 76*a* that opens toward the lower region 70*a*, and the outlet 76*a* is disposed at a position lower than the inlet 73*a*. In a state where the ink supplying tube 26 is connected to the tube mounting portion 76, the lower region 70*a* of the ink storage space 70 of the sub tank 27 is brought into fluid communication with the buffer tank 23 (see FIG. 2) of the image recording unit 16 via the ink supplying tube 26. The sub tank 27 has a labyrinth flow path 77 that continues to an upper end of the tubular portion 72 and is brought in fluid communication with the upper region 70*b*. The labyrinth flow path 77 is in fluid communication with an atmosphere opening port 78 formed at an upper portion of the sub tank 27.

A relationship of the threshold level of the main tank 29 detected by the remaining amount detecting sensor 30 and a volume of the sub tank 27 will be described. As shown in FIG. 3, $M_H$ is an ink amount in the main tank 29 in a fully filled state (new state). $M_N$ is an ink amount in the main tank 29 at a point at which the controller 31 (see FIG. 2) determines that "the ink level is positioned equal to or below the threshold level" (see also FIG. 6) based on a signal output from the remaining amount detecting sensor 30 due to descending of the float portion 55 of the sensor arm 53. $S_H$ is an ink amount in the sub tank 27 in a balanced state (see FIG. 8) at which the ink has flowed into the sub tank 27 due to a hydraulic head pressure on mounting of the main tank 29 with fully filled ink (new state) to the main tank mounting unit 28 (see FIG. 2). $S_L$ is an ink amount in the sub tank 27 in a state where the ink level is positioned at the outlet 76*a* of the sub tank 27 (the state at which the liquid level has lowered and immediately before the air contacts with the outlet 76*a*). The threshold level of the main tank 29 detected by the remaining amount detecting sensor 30 and the volume of the sub tank 27 are then set so that the relationship, $S_H-S_L \leqq M_H-M_N$, is satisfied.

Also, the threshold level detected by the remaining amount detecting sensor 30 has a tolerance (upper limit value and lower limit value) due to manufacturing variation. In consideration thereof, the positions of the inlet 73*a* and the outlet 76*a* of the sub tank 27 are set. Specifically, the positions are set to satisfy the following equation: $S_M-S_L \geqq M_{N1}-M_{N2}$. In this equation, $S_M$ is an ink amount in the sub tank 27 in a state where the ink level is positioned at the lower edge of the inlet 73*a* of the sub tank 27; $M_{N1}$ is an ink amount in the main tank 29 when the upper limit value of the remaining amount detecting sensor 30 is detected; and $M_{N2}$ is an ink amount in the main tank 29 when the lower limit value of the remaining amount detecting sensor 30 is detected. Here, the upper limit value and the lower limit value in this description indicates an upper limit value and a lower limit value of a detection variation of the remaining amount detecting sensor 30, which is obtained by performing a sampling study of a considerable number of inkjet printers 3.

Figure 5:
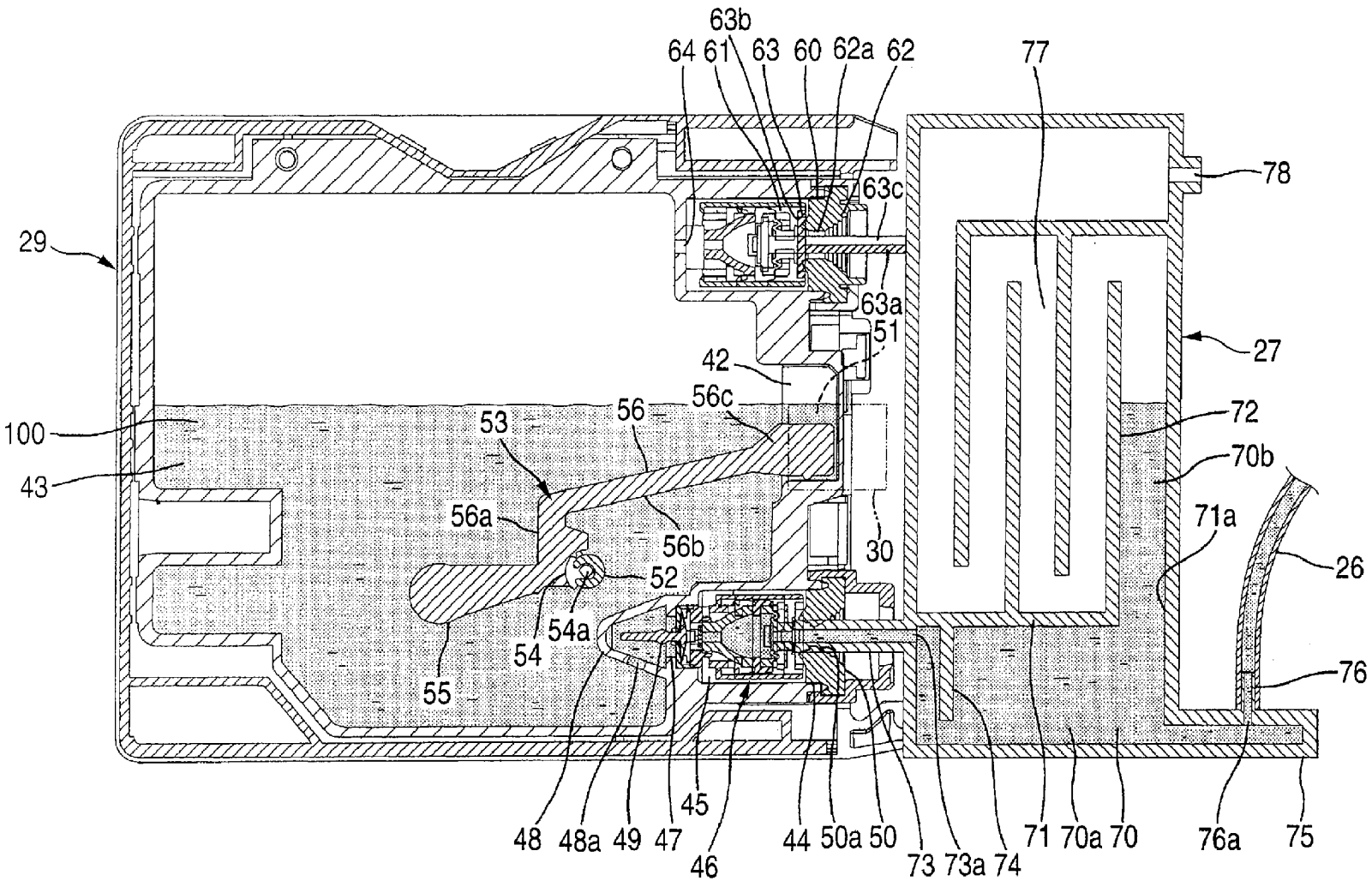
FIG. 5 is a vertical sectional view of the main tank and the sub tank during normal use.

Operation of the inkjet printer 3 will be described with reference to FIGS. 5 to 8. FIG. 5 is a vertical sectional view of the main tank 29 and the sub tank 27 during normal use. As shown in FIG. 5, in a state where the main tank 29 is mounted, the needle portion 73 of the sub tank 27 is inserted into the ink outflow port 50*a* of the main tank 29, and the ink supplying valve 46 is open. Therefore, the main tank 29 and the sub tank 27 are brought into fluid communication with each other. Also in the state where the main tank 29 is mounted, the rod portion 63*a* of the atmosphere opening valve 63 is pressed against an outer wall of the sub tank 27 and is retreated in the valve housing chamber 61. Therefore, the ink storage chamber 43 is open to the atmosphere. Furthermore, the ink storage space 70 of the sub tank 27 is open to the atmosphere at all times via the atmosphere opening pore 78. The hydraulic head pressures of the ink in the main tank 29 and the sub tank 27 make a balanced state where the ink level in the main tank 29 is equal to the ink level in the sub tank 27.

Also in the state of FIG. 5, since the ink is adequately stored in the ink storage chamber 43 and the float portion 55 of the sensor arm 53 is raised, the blocking portion 56*c* of the sensor arm 53 enters into the recess 42 and is sandwiched by the light transmitting portions 51 at both side walls. Therefore, the light emitted from the light emitting portion 30*a* (see FIG. 4) of the remaining amount detecting sensor 30 is blocked by the blocking portion 56*c* and is not detected by the light receiving portion 30*b* (see FIG. 4). At this state, the controller 31 determines (see FIG. 2) that "the ink level is positioned above the threshold level."

Figure 6:
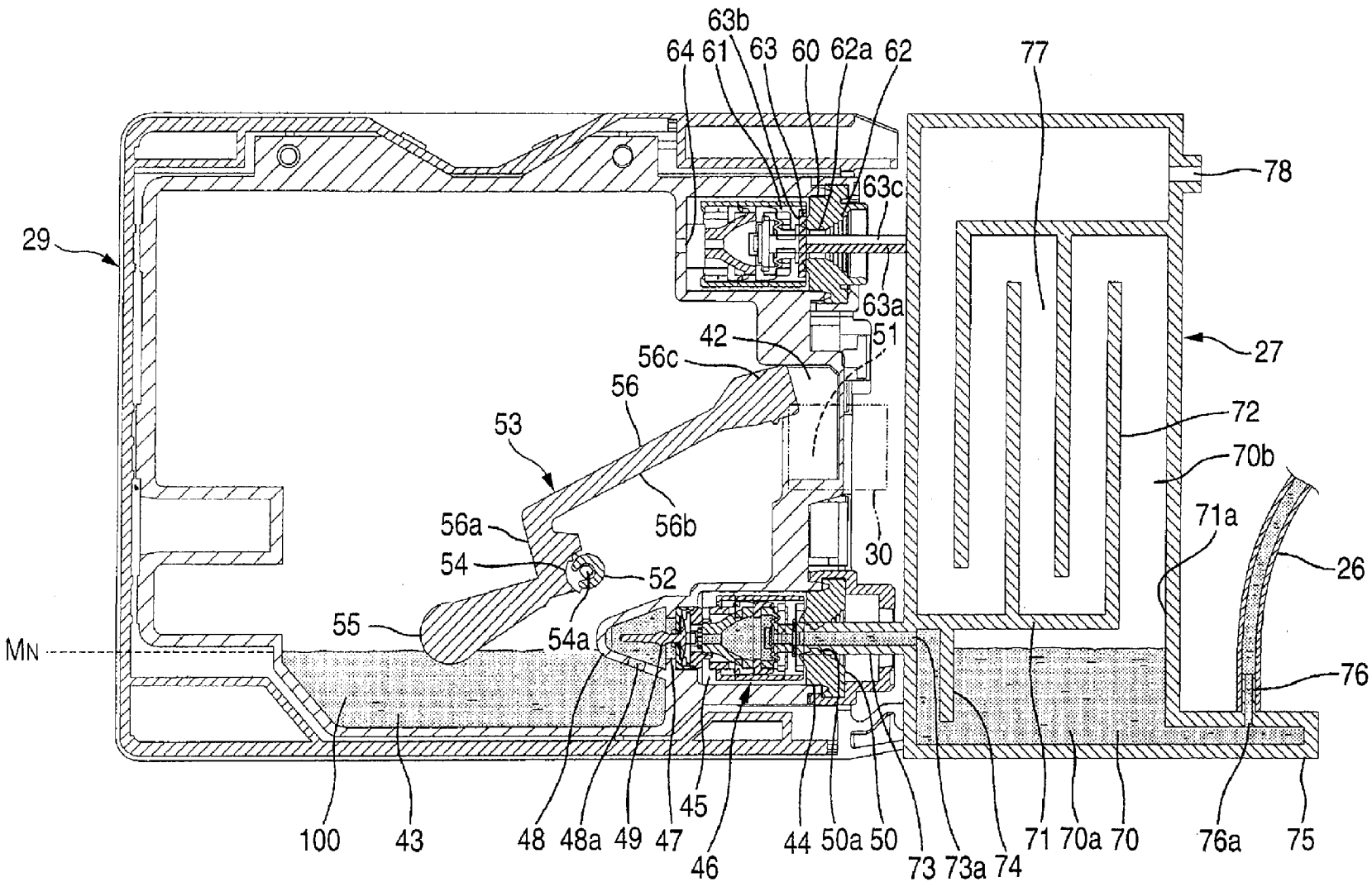
FIG. 6 is a vertical sectional view of the main tank and the sub tank at a point in time of remaining amount detection.

FIG. 6 is a vertical sectional view of the main tank 29 and the sub tank 27 at a point in time of remaining amount detection. As shown in FIG. 6, when the ink in the main tank 29 decreases to the threshold level $M_N$, the float portion 55 of the sensor arm 53 descends and the blocking portion 56 contacts and stops at an upper wall surface of the recess 42. When this state is entered, the light emitted from the light emitting portion 30*a* (see FIG. 4) of the remaining amount detecting sensor 30 is detected by the light receiving portion 30*b* (see FIG. 4) via the light transmitting portions 51 (see FIG. 4) without being blocked by the blocking portion 56*c*. It is thus judged primarily at the controller 31 (see FIG. 2) that "the ink level is equal to or below the threshold level" (remaining amount detection). From this point of remaining amount detection, the remaining amount counting unit 34 of the controller 31 performs cumulative calculation of the ink amount ejected from the inkjet head 22 based on print data received by the print data receiving unit 33 from the personal computer 11 as shown in FIG. 2 (remaining amount calculation). When the remaining ink amount calculated by the remaining amount counting unit 34 decreases to an amount at which the ink level in main tank 29 reaches the inflow port 48*a*, the controller 31 judges that "the remaining ink amount is zero" and transmits this information from the remaining amount transmitting unit 35 to the personal computer 11.

Figure 7:
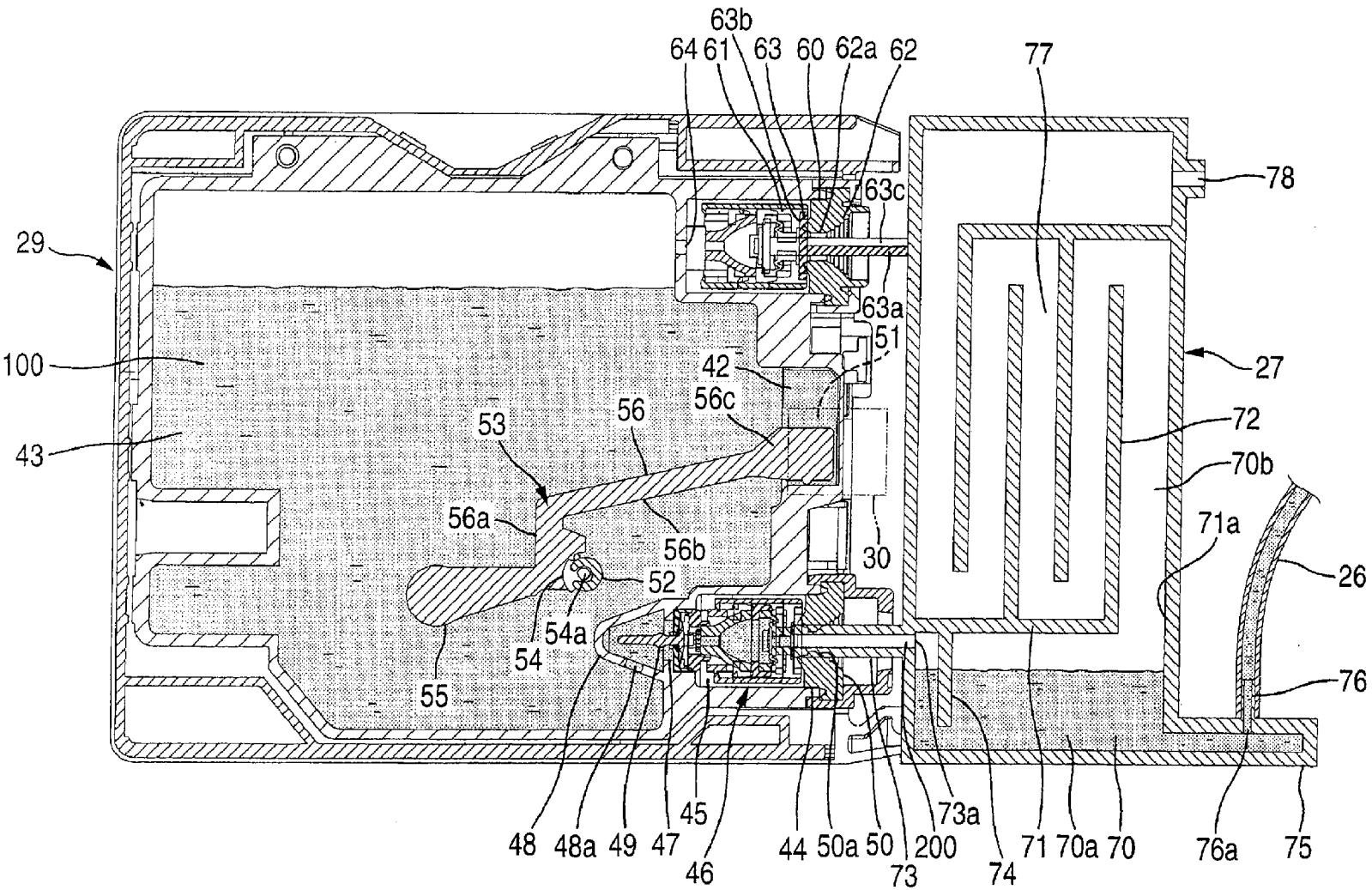
FIG. 7 is a vertical sectional view of the main tank and the sub tank immediately after main tank exchange.
Figure 8:
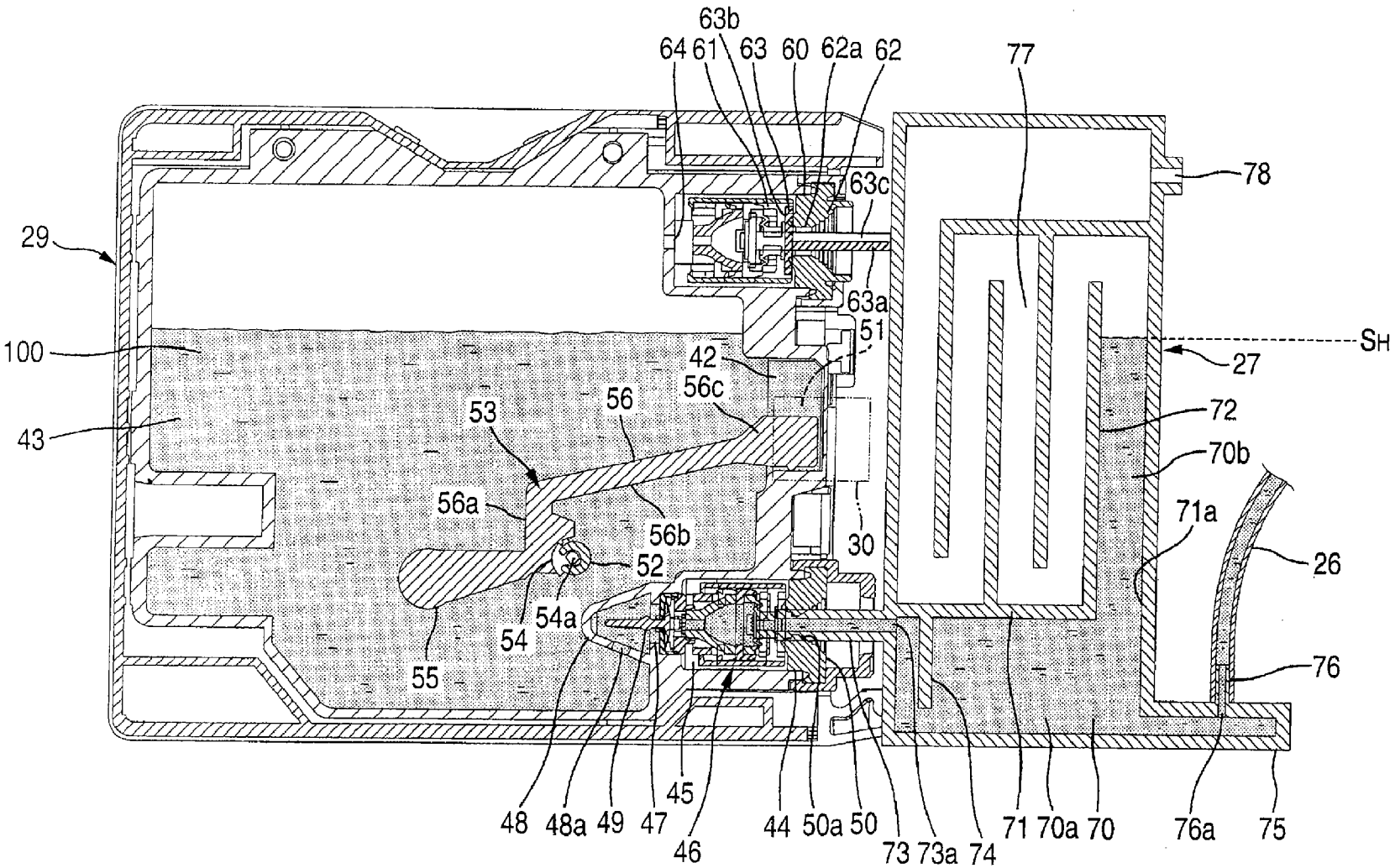
FIG. 8 is a vertical sectional view of the main tank and the sub tank in a balanced state after main tank exchange.

FIG. 7 is a vertical sectional view of the main tank 29 and the sub tank 27 immediately after main tank exchange. FIG. 8 is a vertical sectional view of the main tank 29 and the sub tank 27 in the balanced state after main tank exchange. When the massage "the remaining ink amount is zero" is displayed by the personal computer 11, a user exchanges the main tank 29 with a new tank accordingly. Then as shown in FIG. 7, since the ink level in the main tank 29 has fallen considerably, air 200 enters the flow path between the main tank 29 and the sub tank 27, that is, into the flow path in the needle portion 73. However, immediately after the main tank 29 is replaced by the new tank, ink flows from the main tank 29 into the sub tank 27 due to the hydraulic head pressure of the ink in the main tank 29, and then the balanced state of FIG. 8 is entered. In this process, the air 200 undergoes gas-liquid separation at the lower region 70*a* of the sub tank 27 due to its buoyancy, and is discharged from the atmosphere opening port 78 via the upper region 70*b* and the labyrinth flow path 77.

According to the configuration described above, in the balanced state at which, upon mounting of the new main tank 29 with fully filled ink to the main tank mounting unit 28, the ink in the main tank 29 has flowed into the sub tank 27 due to the hydraulic head pressures and the ink levels in the main tank 29 and the sub tank 27 have reached substantially the same height, the ink levels are not below the threshold level that is the detection threshold of the remaining amount detecting sensor 30. As the ink in the main tank 29 decreases gradually due to the ink being consumed via the inkjet head 22, the level of the ink in the main tank 29 firstly reaches the threshold level. The remaining amount calculation with software by the remaining amount counting unit 34 of the controller 31 then starts at the point at which the ink level in the main tank 29 matches the threshold level. Therefore, the initial value of the remaining ink amount of the remaining amount calculation matches the actual remaining ink amount. The remaining amount detection and the remaining amount calculation can be used to precisely detect the remaining ink amount in the main tank 29 even while improving the performance of using the ink in the main tank 29.

Furthermore, if an error occurs in the detection by the remaining amount detecting sensor 30 so that the remaining amount detecting sensor 30 detects the threshold level although the actual level is positioned at a level slightly lower than the threshold level, the remaining amount counting unit 34 of the controller 31 may judge that ink still remains even when the ink in the main tank 29 runs out. However, since the outlet 76*a* of the sub tank 27 is disposed at the position lower than the inlet 73*a*, the ink remaining in the sub tank 27 is supplied to the inkjet head 22, thereby preventing the air from being supplied to the inkjet head 22 side.

Also, since the level difference between the inlet 73*a* and the outlet 76*a* of the sub tank 27 is set large in consideration of the tolerance due to manufacturing variations of the remaining amount detecting sensor 30, an adequate amount of ink to be supplied to the inkjet head 22 side can be made to remain in the sub tank 27 even when the ink in the main tank 29 runs out.

Furthermore, since the horizontal cross-sectional area of the upper region 70*b* of the sub tank 27 is considerably smaller than the horizontal cross-sectional area of the lower region 70*a*, when the ink in the main tank 29 flows into the sub tank 27 due to the hydraulic head pressure, the ink levels in the main tank 29 and the sub tank 27 become equal in height with a low inflow amount. Therefore, an adequate ink volume to be supplied to the inkjet head 22 side is secured in the lower region 70*a*. Also, the ink in the main tank 29 can be favorably prevented, during exchange of the main tank 29, from falling below the threshold level that is the detection threshold of the remaining amount detecting sensor 30. Although in the above-described embodiment, the present invention is applied to an inkjet printer, the present invention may be applied to a liquid ejection device that ejects liquid other than ink.

The remaining amount detecting sensor 30 optically detects a remaining ink amount. Accordingly, the liquid level in the main tank can be detected easily in a non-contacting manner. Although the remaining amount detecting sensor 30 is configured to optically detect the sensor arm 53 provided in the main tank 29 in the above embodiment, the remaining amount detecting sensor 30 is not limited to this example. For example, the remaining amount detecting sensor 30 may optically detect the liquid level directly or may detect indirectly using a float provided in the main tank 29. In addition, the remaining amount detecting sensor may perform other than the optical detection.

As described above, the liquid ejection device according to the present embodiment exhibits the excellent advantage that the remaining amount detecting unit and the remaining amount calculating unit can be used to precisely detect the remaining liquid amount in the main tank even while improving the performance of using the main tank liquid to depletion, and is beneficially applied to an inkjet printer, etc., with which the significance of this effect can be exhibited.

What is claimed is:

1. A liquid ejection device comprising:

a main tank mounting unit to which a main tank capable of storing liquid is removably mountable;

a sub tank comprising:

an inlet configured to be brought into fluid communication with the main tank in a state where the main tank is mounted to the main tank mounting unit; and an outlet;

an ejection head having a nozzle configured to eject the liquid supplied from the sub tank via the outlet;

a remaining amount detecting unit configured to detect whether an amount of the liquid in the main tank is equal to or smaller than a predetermined liquid amount, where a liquid level of the liquid in the main tank at the predetermined liquid amount is positioned at a threshold level; and a remaining amount calculating unit configured to determine a liquid amount ejected from the ejection head during a term starting from a detection of the threshold level by the remaining amount detecting unit, thereby calculating a remaining liquid amount in the main tank;

wherein the sub tank is configured to satisfy the following formula:

$S_H - S_L \leqq M_H - M_N$ where, $S_H$ is a liquid amount in the sub tank in a balanced state at which the liquid has flowed into the sub tank by a hydraulic head pressure on mounting the main tank with the liquid fully filled;

$S_L$ is a liquid amount in the sub tank in a state where the liquid level is positioned at the outlet of the sub tank;

$M_H$ is a liquid amount in the main tank when the liquid is fully filled in the main tank; and $M_N$ is a liquid amount in the main tank in a state where the liquid level is positioned at the threshold level, and wherein the main tank mounted to the main tank mounting unit is disposed adjacent to the sub tank in a horizontal direction, and the liquid level in the main tank is equalized to the liquid level in the sub tank by the hydraulic head pressure of the liquid in the main tank and the sub tank when the main tank in a fully filled state is mounted to the main tank mounting unit.

2. The liquid ejection device according to claim 1, wherein the outlet of the sub tank is disposed at a position lower than the inlet.

3. The liquid ejection device according to claim 2, wherein the threshold level detected by the remaining amount detecting unit has an error range from a lower limit value to an upper limit value, and wherein the sub tank is configured to satisfy the following formula:

$S_H - S_L \geqq M_{N1} - M_{N2}$ where, $S_M$ is a liquid amount in the sub tank in a state where the liquid level is positioned at the inlet of the sub tank;

$M_{N1}$ is a liquid amount in the main tank when the upper limit value of the remaining amount detecting unit is detected; and $M_{N2}$ is a liquid amount in the main tank when the lower limit value of the remaining amount detecting unit is detected.

4. The liquid ejection device according to claim 1, wherein the sub tank having a liquid storage space defined therein, the liquid storage space having a lower region and an upper region, wherein the inlet and the outlet are provided as openings in the lower region, and wherein a horizontal cross-sectional area of the upper region is smaller than a horizontal cross-sectional area of the lower region.

5. The liquid ejection device according to claim 4, wherein the sub tank comprises:

a wall portion configured to divide the sub tank into the upper region and the lower region and having a communicating hole that is formed at a portion of the wall portion and allows fluid communication between the upper region and the lower region and; and a tubular portion that protrudes upward from a periphery of the communicating hole, wherein the upper region is defined by the tubular portion.

6. The liquid ejection device according to claim 1, wherein the remaining amount detecting unit is configured to optically detect the liquid level in the main tank.

7. The liquid ejection device according to claim 1, wherein the sub tank is disposed adjacent to the main tank mounting unit.

8. The liquid ejection device according to claim 1, wherein at least a portion of the sub tank is positioned lateral to the main tank mounting unit.

9. The liquid ejection device according to claim 1, wherein the sub tank defines therein a liquid storage space, and the liquid storage space extends to substantially equal to or above a fully-filled liquid level in the main tank in a state where the main tank is mounted to the main tank mounting unit.

* * * * *